United States Patent [19]

Hancovsky

[11] Patent Number: 5,055,035

[45] Date of Patent: Oct. 8, 1991

[54] MEMORIAL CANDLE FIXTURE

[75] Inventor: John P. Hancovsky, McMurray, Pa.

[73] Assignee: Matthews International Corporation, Pittsburgh, Pa.

[21] Appl. No.: 536,207

[22] Filed: Jun. 11, 1990

[51] Int. Cl.[5] ..... F23D 3/16

[52] U.S. Cl. ..... 431/291; 362/161; 362/163; 362/180; 362/315

[58] Field of Search ..... 431/291, 289; 362/161, 362/163, 180, 315, 316, 354, 356, 806; 52/104; 40/574

[56] References Cited

U.S. PATENT DOCUMENTS

| | | | |
|---|---|---|---|
| 83,799 | 11/1868 | Thompson | 362/180 |
| 578,859 | 3/1897 | Brown et al. | 362/180 |
| 756,994 | 4/1964 | Valleen | 362/315 |
| 2,001,312 | 5/1935 | O'Connell | 431/291 X |
| 2,060,324 | 11/1936 | Knapp | 240/13 |
| 2,080,251 | 7/1934 | Buskard | 240/13 |
| 2,188,797 | 8/1937 | Root et al. | 240/13 |
| 2,214,991 | 9/1940 | Candy, Jr. | 431/291 X |
| 2,254,664 | 9/1941 | Quinlan | 240/13 |
| 2,439,467 | 4/1948 | Guilfoil, Jr. | 240/13 |
| 3,434,235 | 3/1969 | Gordon et al. | 47/41.1 |
| 4,224,017 | 9/1980 | Kayne | 431/291 |
| 4,260,365 | 4/1981 | Kagne | 362/161 X |
| 4,262,325 | 4/1981 | Garcia | 362/121 |
| 4,787,017 | 11/1988 | Vrettos | 362/161 |

FOREIGN PATENT DOCUMENTS

| | | | |
|---|---|---|---|
| 2317313 | 4/1973 | Fed. Rep. of Germany | 52/104 |

*Primary Examiner*—Carl D. Price

*Attorney, Agent, or Firm*—Webb, Burden, Ziesenheim & Webb

[57] ABSTRACT

A memorial candle fixture includes a cast frame member comprising two substantially identical mating frame halves, preferably cast from bronze. Each frame half has a top portion and a base portion interconnected by two pairs of ribs which are positioned at a vertical parting plane extending along the faces of the mating frame halves. An open region is defined between the top and base portions and ribs of the frame halves for placement of a candle and an enclosing decorative candle cover therein. The frame halves carry interlocking members on the top and base portions for detachably securing the frame halves together whereby the candle and its cover are securely confined within the open region. The base carries peripheral lugs on a flared pedestal thereof for locking engagement with a memorial plate installed at the grave site.

13 Claims, 6 Drawing Sheets

MEMORIAL CANDLE FIXTURE

BACKGROUND OF THE INVENTION

The present invention relates generally to candle holders or fixtures and more particularly to memorial candle fixtures for use in cemeteries and the like.

It is readily appreciated that memorial candle fixtures are usually placed in out-of-doors locations and, therefore, should be capable of withstanding the rigors of long-term exposure to the elements. The fixture design should be aesthetically pleasing while also providing protection to prevent extinction of the candle flame due to wind or rain. Additionally, the fixture should be of sturdy construction in order to resist inadvertent damage caused by cemetery workers which, for example, may occur during grass cutting, excavation or other maintenance work. The fixture should, of course, also allow for easy replacement of the candle element. Ideally, the fixture should be resistant to theft, while also being relatively simple to manufacture so as to minimize the cost thereof without sacrificing the above objectives. Heretofore, no memorial candle fixture has possessed all of these desired qualities.

The present invention solves the problems experienced in the past by providing a memorial candle fixture which comprises a minimum number of component parts for ease of manufacture, assembly and concurrent minimization of costs. The present invention further provides a memorial candle fixture which is sturdy and resistant to field abuse and adverse weather conditions, while also offering an attractive appearance with easy access for candle replacement purposes. The fixture of the present invention also minimizes hot spots around the burning candle so as to eliminate localized melting and thus increase service life. The memorial candle fixture of the invention still further includes a base portion which detachably engages an in-ground holder which permits inversion of the fixture for subterranean storage thereof during grass cutting operations, for example.

SUMMARY OF THE INVENTION

These as well as other features and advantages are achieved by the memorial candle fixture of the present invention which, briefly stated, comprises a fixture housing or frame, made preferably from a bronze casting. The fixture frame is formed of two substantially identical halves; a lugged frame half and a slotted frame half. The lugged frame half has a sloped top portion having a central protrusion, which slopes downwardly to an edge portion having a semicircular shape in plan view. A lug carrying an offset edge outwardly extends from an inner face of the protrusion of the lugged frame half. The inner face coincides with a vertical parting plane defined between the two frame halves. A pair of ribs extends downwardly from the top at diametrically opposed points on the semicircular edge portion to a base. An open region is defined between the top, base and rib portions. The base of the lugged frame half is also in the form of a semicircular shape in plan view and further includes a pedestal at a distal end which carries a plurality of radially spaced, outwardly extending locking lugs around an outer perimeter thereon. An inner region of the base portion carries an apertured tongue formed therein which outwardly extends beyond the parting line.

The slotted frame half of the fixture frame also has a similarly shaped top and base joined by a pair of ribs extending along a vertical parting plane to join with the lugged fixture half along a common parting plane when the frame halves are mated. The slotted frame half has a central protrusion on the sloped top thereof having a slot formed therein for registry of the lug carried by the lugged fixture half. The slot has a horizontal axis which is offset from a horizontal axis of the lug to permit the insertion of the lug and offset edge therein. An upward movement of the lug causes the offset edge of the lug to lockably engage a face of the protrusion adjacent the slot to prevent horizontal movement of the lug relative to the slot. The base region of the slotted frame half of the fixture also carries an outwardly extending tongue having a threaded aperture therein which overlies the apertured tongue carried by the lugged frame half. A locking bolt is positioned within the overlying tongues and is threadably secured therein, whereby the two frame halves are joined together. The base portion of the slotted frame half also has a pedestal region which carries one or more radially spaced locking lugs outwardly extending thereon. The locking lugs of the pedestal base are adapted to lock into a mounting rim carried by a known holder such as a conventional memorial plate installed at the cemetery site.

The memorial candle fixture of the invention further includes a cylindrically-shaped, transparent or opaque plastic candle cover containing a candle therein. The candle cover is positioned within the open region defined within the frame halves, extending between the top and the base portions and confined within the vertically extending ribs thereof. The base of the joined frame halves has a flat, annular ledge formed around the inside thereof to provide a seating surface for stable alignment of the candle and the surrounding candle cover. The candle and cover are, of course, inserted into the fixture when the frame halves are in a disassembled state. A metal shield having decorative perforations formed therethrough is positioned against the inside wall of the plastic candle cover and has an upper edge which extends beyond an upper edge of the cover to engage an inside surface of the top of the metal frame. In this manner, the metal shield centers the upper edge of the plastic cover and dissipates the candle heat to prevent hot spots around the plastic cover, while keeping the plastic edge of the cover spaced from the top of the hot metal frame. The metal frame also preferably has a plurality of horizontal holes formed in the top thereof to provide a natural air draft for proper burning of the candle therein.

BRIEF DESCRIPTION OF THE DRAWINGS

These, as well as other features and advantages, will become more apparent when reference is made to the following drawings, in which.

DETAILED DESCRIPTION OF THE INVENTION

Figure 1:
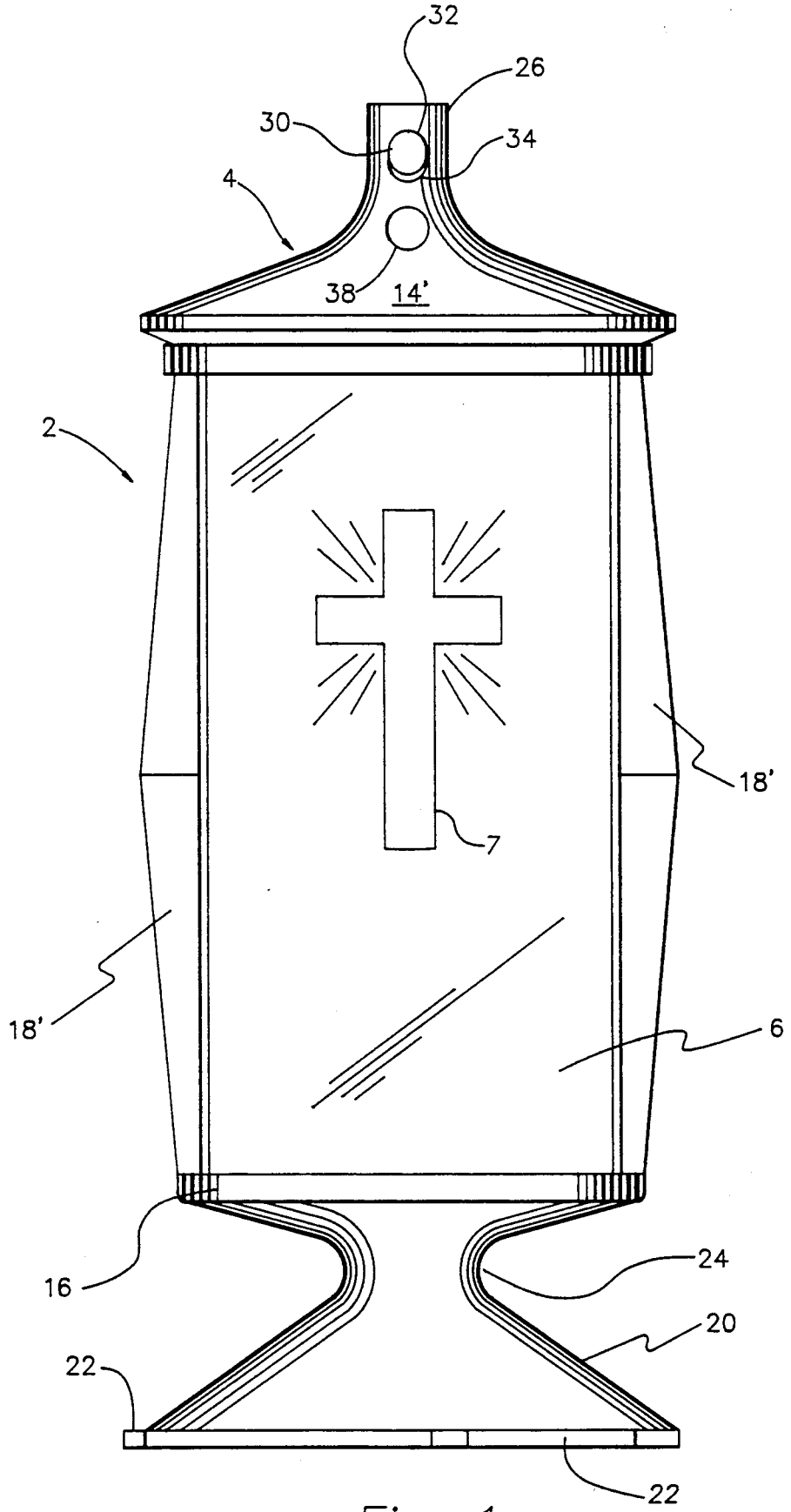
FIG. 1 is a front elevation view of a presently preferred embodiment of the memorial candle fixture according to the present invention.

Referring now to the drawings, wherein identical elements are identified by like reference numerals and similar elements are identified by primed numerals, the memorial candle fixture of the invention is identified generally by the numeral 2. The memorial candle fixture 2 comprises a metal casting or frame generally designated 4 which holds a candle cover 6 and an encased candle 15 therein.

The frame 4 is preferably formed of a cast bronze material which is attractive in appearance while offering weatherability, strength and heat resistance. The frame 4 is made up of two, nearly identical frame halves 8 and 10 which are perhaps best seen in FIGS. 2 and 3. In a mated or assembled condition depicted in FIG. 2, the frame halves 8 and 10 mate along a parting plane 12 which vertically extends along a plane passing through a central vertical axis of the fixture 2 and which defines a lane of near symmetry for both of the frame halves. In the joined condition, the frame halves 8 and 10 describe a generally cylindrical shape at a top portion 14, 14, and at a base portion 16, 16', defining an open interior region therebetween. As will be explained in greater detail hereinafter, two pairs of ribs 18, 18' interconnect the top and base portions 14, 14' and 16, 16,' respectively, of the frame halves 8 and 10.

For sake of convenience, frame half 8 is also referred to as the lugged half, since it carries a lug 30; and frame half 10 as the slotted half, since it has a slot 34 formed therein. Each of the frame halves 8 and 10 have an upwardly extending central protrusion 26, 26', in the shape of a half-cylinder. When joined along the parting plane 12, the central protrusions 26, 26' form a cylindrical shape, as can be appreciated with reference to FIGS. 1–3 and 7.

Figure 4:
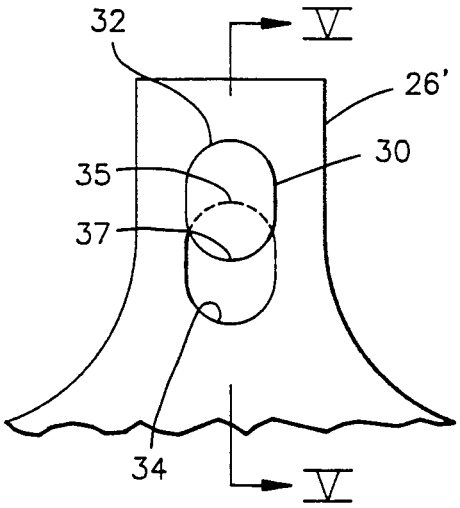
FIG. 4 is an enlarged fragmentary view of a lug and slot locking arrangement of the fixture according to the invention.
Figure 5:
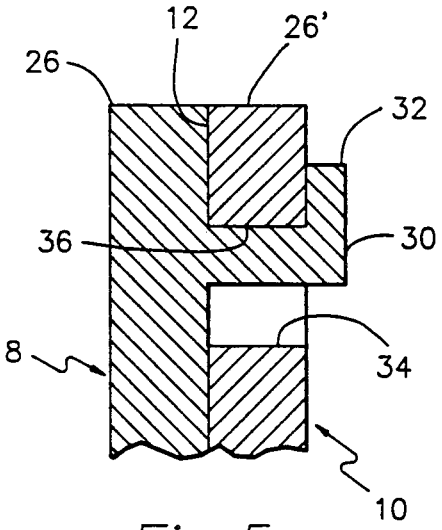
FIG. 5 is a cross-sectional view taken along line V—V of FIG. 4.

The aforementioned lug 30 outwardly extends from the face of the lugged frame half 8 along parting plane 12 and terminates in an offset edge or toe portion 32, see also FIGS. 4 and 5. The end of the offset edge portion 32 of the lug 30 preferably has an oval shape as seen in FIG. 4 which conforms to the shape of the slot 34 formed in the protrusion 26' to permit the lug 30 and its offset portion 32 to pass therethrough. The offset edge portion 32 is spaced outwardly from the parting plane 12 a distance represented by the line segment 36 in FIG. 5 which is substantially equal to the width of the protrusion 26' in order to insure a snug locking fit between the offset edge portion 32 of the lug 30 and the protrusion 26'. As seen in FIG. 4, the respective longitudinal axes 35 and 37 of the lug 30 and slot 34 are vertically offset to permit the area of protrusion 26' above the segment 36 to lockably engage with the offset edge 32 when the frame halves 8 and 10 are assembled in a mated state as shown in greater detail in FIG. 5.

Figure 7:
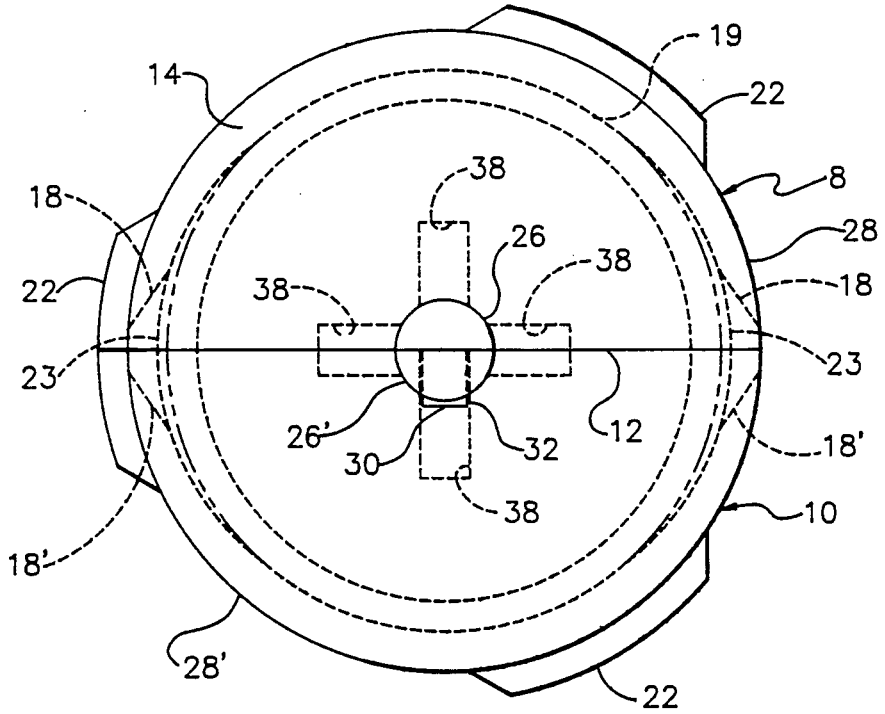
FIG. 7 is a top plan view of the fixture of FIGS. 1 and 2.

The respective top portions 14, 14' of the lug half 8 and slot half 10 slope downwardly from the central protrusions 26, 26' and terminate at an edge or perimeter 28, 28, As seen in the top view depicted in FIG. 7, top edges 28 and 28, are in the shape of two identically sized semicircles which meet along the parting plane 12 to form a complete circle when in the joined condition. Respective pairs of vertical ribs 18, 18' extend vertically from diametrically opposed ends of each of the top edges 28, 28' to join with a respective base portion 16, 16' of the frame halves 8 and 10, FIG. 2.

Figure 2:
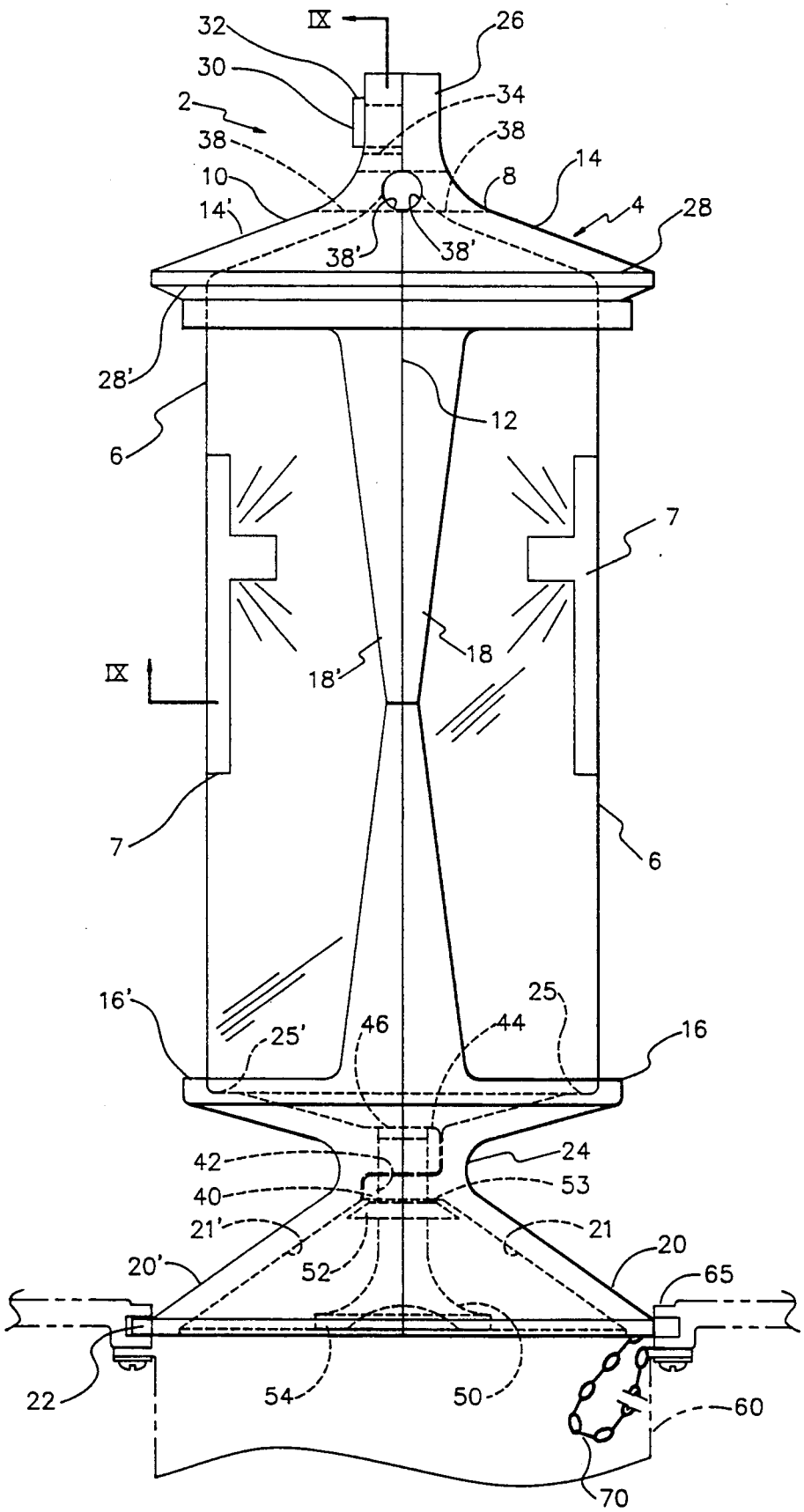
FIG. 2 is a side elevation view of the fixture of FIG. 1 showing a memorial plate mounting arrangement in phantom lines.
Figure 8:
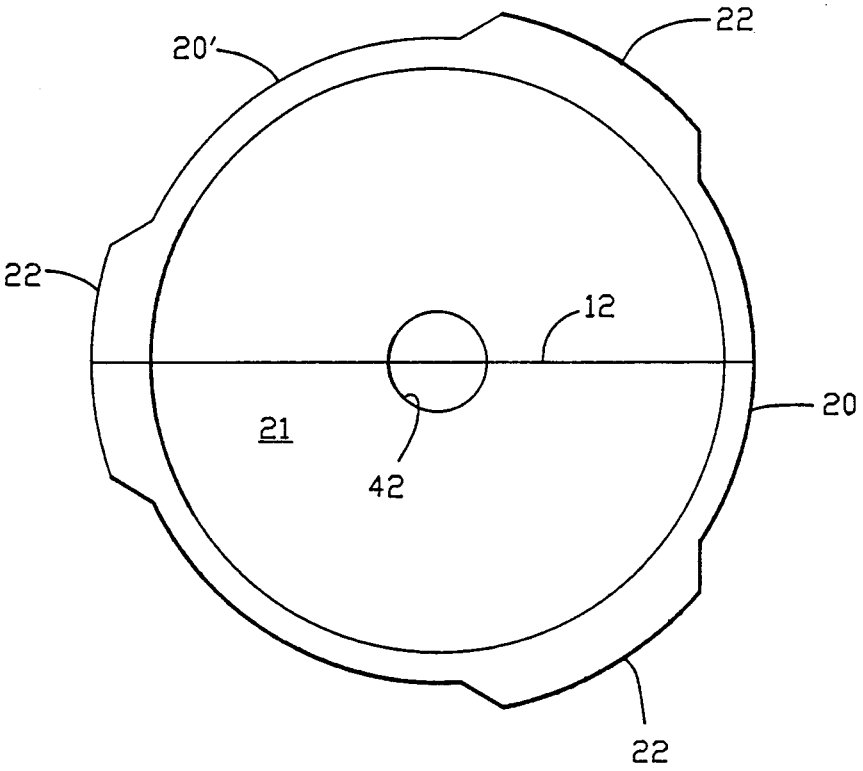
FIG. 8 is a bottom plan view of the locking lugs carried by the pedestal base of the fixture according to the invention.

The base portions 16, 16' have respective flat surfaces 25, 25' formed therein which define an annular seating surface for engagement with a lower edge of the candle cover 6 as also shown in FIG. 2. The base portions 16, 16' taper inwardly to form a necked region 24 and thence taper outwardly to form pedestal portions 20, 20' at the bottom thereof. As seen in FIG. 8, the pedestal portions 20, 20' when in the assembled state also describe a circular shape in plan view.

In order to maintain the joined frame halves 8 and 10 in the mated state, each of the frame halves is provided with an integral overlapping tongue 40 and 44. The tongues are bolted together by a fastener bolt 50, FIG. 2. As perhaps best seen in FIG. 3, frame half 8 has an extended tongue 40 integrally formed on an interior surface adjacent the necked portion 24 of the base 16. The tongue 40 also has a bore 42 formed therethrough, the longitudinal axis of which preferably lies in the parting plane 12 of the frame half 8. The slotted frame half 10 also has an extended tongue 44 integrally formed on its interior surface, adjacent the necked portion of the base. The tongue 44 also has a threaded bore 46 formed therein whose longitudinal axis also lies in the parting plane 12 of the frame half 10.

Figure 3:
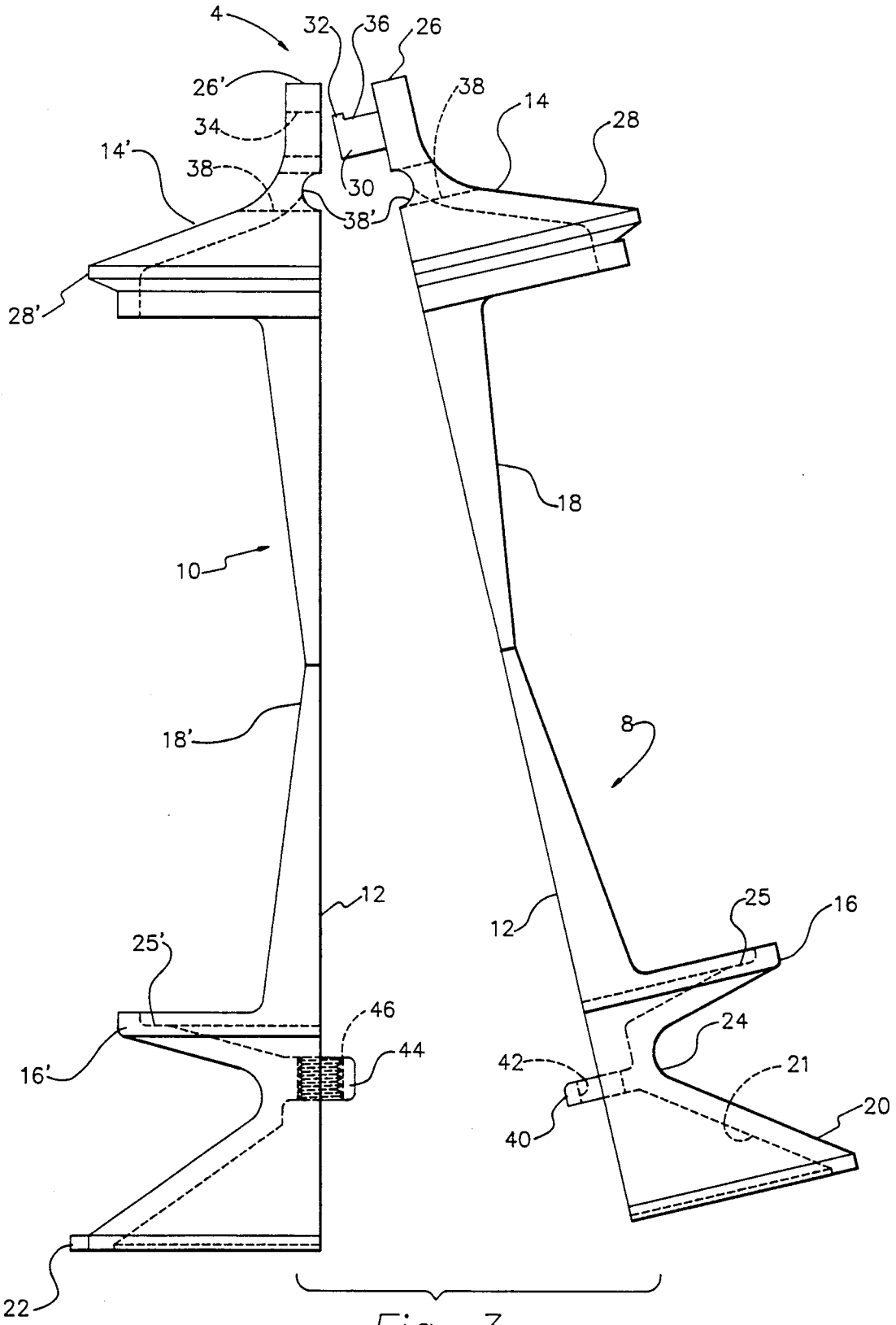
FIG. 3 is a side elevation view of two frame halves of the candle fixture in a disassembled condition.
Figure 6:
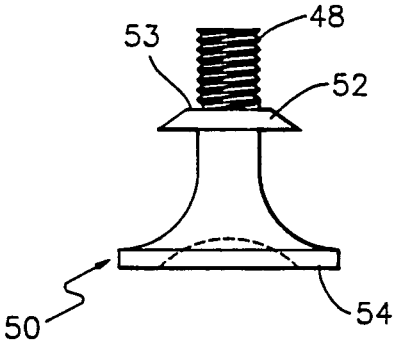
FIG. 6 is a side elevation view of a bolt suitable for fastening the frame halves depicted in FIGS. 1–3 and 8.

The frame halves 8 and 10 are joined together by first inserting the lug 30 into the slot 34 as shown in FIGS. 2 and 3 and then moving the lugged frame half 8 upwardly relative to the slotted half 10 to cause locking registry of the offset edge 32 of the lug 30 on the face of the protrusion 26'. This relative upward movement of the frame halves 8 and 10 also simultaneously causes the tongues 40 and 44 to move into a mated, overlying position as shown in FIG. 2 wherein the respective bores 42 and 46 are axially aligned. In order to hold the frame halves 8 and 10 in the joined state, the fastener bolt 50 is employed, as seen in FIGS. 2 and 6. The bolt 50 has a threaded shaft 48 which engages the threaded bore 46 of the tongue 44. The bolt 50 also has a flanged seat with a chamfered edge 52 which is so shaped to provide clearance with the tapered interior surface 21 of the pedestal 20. This configuration permits the flat surface 53 of the flanged seat to bear against the bottom surface of the tongue 40 when the bolt 50 is fully engaged within the threads 46 of the tongue 44. The fastener bolt 50 also has an enlarged head portion 54 to facilitate manual torquing thereof for easier insertion and removal of the bolt, eliminating the need for special tools.

The lower edges of the pedestal portions 20, 20' carry one or more outwardly extending, radially spaced locking lugs 22. Preferably, three such lugs 22 are employed, spaced at 120° intervals around the perimeter of the pedestal portion when the frame halves are in the joined state, FIGS. 8–9. The pedestal and integral lugs 22 are adapted to be lockably received within a like slotted holder and receptacle of the type disclosed in U.S. Pat. No. 3,434,235 and commonly owned by the present Assignee. The prior art device is commonly used for mounting flower or ground vases in a conventional bronze memorial plate installed at the grave site. The prior art memorial plate comprises a hollow, cylindrical receptacle 60 with a locking rim 65 located at the opening in the memorial plate which is adapted to supportably engage the pedestal 20, 20' and lugs 22 in a known manner. The hollow cylindrical receptacle 60 of the prior art is usually plastic and is located in the ground with the locking rim 65 of the bronze memorial plate positioned at or slightly above ground level. When the grass around the grave site is to be mowed, the fixture 2 is rotated in order to disengage the lugs 22 from the locking rim of the memorial plate 65. The fixture 2 may then be inverted 180° and stored within the confines of the inground, cylindrical receptacle 60 until the mowing work is completed so as to avoid accidental damage to the fixture 2. A length of chain 70 is also preferably attached at one end to the pedestal 20 and at the other end to the memorial plate 65 so as to prevent unwanted removal or to deter theft of the memorial candle fixture 2 from the grave site.

The candle assembly is placed within the frame 4 when the frame halves 8 and 10 are in the disassembled condition. The candle assembly comprises the candle cover 6 which is a hollow cylinder, preferably made from an opaque, high-impact resistant plastic, such as a polycarbonate material, for example. A glass cover could also be used in the present invention, but breakage always presents a problem. Religious or other decorative indicia, such as a cross 7, may be imprinted on the candle cover 6. The candle cover 6 has a lower edge which is supported and radially aligned by the flat annular seating ledge 25, 25' formed around the interior of the base of the frame 4. A conventional candle 15 is axially positioned within the open interior of the cover 6. The candle is ignited also prior to assembly of the frame halves 8 and 10. During burning, the candle flame 17 requires venting for proper combustion and, for this purpose, horizontally extending vent holes 38 and 38' are formed by drilling or casting in the top 14, 14' of the frame halves 8 and 10. Four such vent holes may be provided at 90° spacings, for example. As seen in FIG. 2, semicircular hole segments 38, are positioned at parting plane 12 of each frame half which form a complete circular hole profile when the frame halves are joined.

Figure 9:
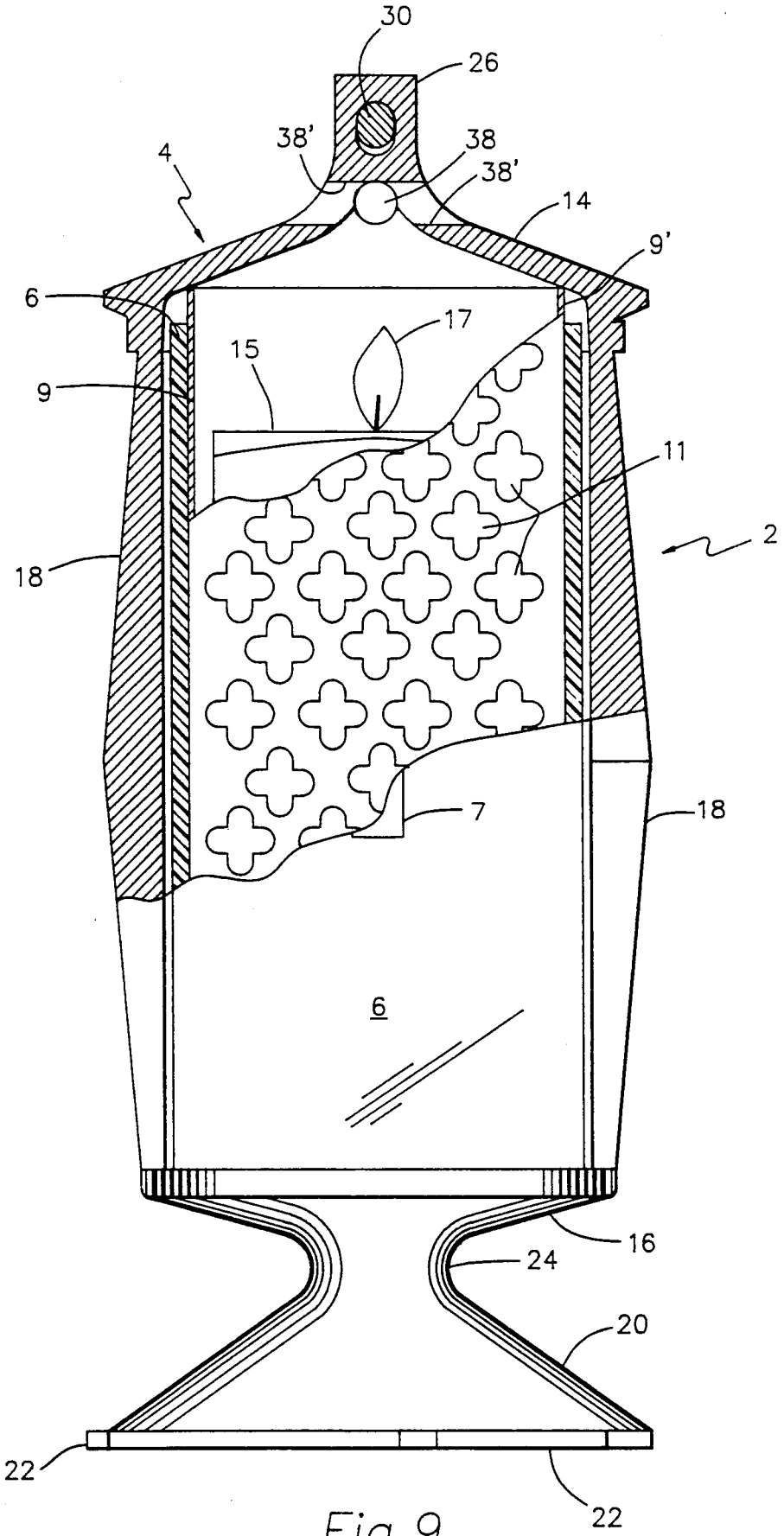
FIG. 9 is a partially fragmented and cross-sectional front elevation view of the memorial candle fixture depicted in FIG. 1.

Heat generated by the candle flame 17 causes the temperature of cast bronze frame 4 to rise, particularly in the top 14 and in the upper regions of the connected ribs 18, FIG. 9. In this regard, in order to prevent localized melting or distortion of the plastic candle cover 6, it is advantageous to maintain some spacing or air gap between the plastic cover 6 and the top portion 14 and ribs 18 of the metal frame 4, particularly adjacent the upper edge of the cover 6. As seen in FIG. 7, the inside annular sidewall 19 of the top 14 is circular in plan view with enlarged or bowed portions 23 adjacent each of the vertical ribs 18, 18' so as to provide a gap between the metal ribs and the plastic candle cover, as depicted in FIG. 9.

In order to further protect the plastic candle cover 6 from localized hot spots around its circumference due to the close proximity of flame 17 as the candle burns down, a metal shield 9 is preferably provided between the candle 15 and the cover 6. The metal shield 9 is constructed of a light gauge sheet material having good heat conductivity, such as aluminum. The metal shield 9 has a plurality of decorative perforations 11 formed therein which permits the passage of candlelight therethrough in an aesthetically pleasing pattern, which is revealed on the exterior of the candle cover 6. As seen in FIG. 9, the metal shield 9 is formed in a cylindrical shape and preferably contacts the inside surface of the candle cover 6. The metal shield has an upper edge 9' which extends beyond the upper edge of the plastic candle cover 6 to contact the inner surface of the top 14 of the frame 4. Thus, in addition to dissipating heat to eliminate localized hot spots, the metal shield 9 also centers the plastic candle cover 6 within the frame 4 and prevents the plastic cover from coming in contact with the hot metal surfaces along the top 14 and ribs 18.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A memorial candle fixture comprising frame means including two mating frame halves, each frame half having a top and a base joined by rib means and defining an open region therebetween for placement of a candle means therein; and means for detachably locking the frame halves together whereby the candle means is confined within the open region and wherein the candle means is confined within the open region and wherein the candle means comprises a cylindrically-shaped candle cover member of a light-transmitting plastic material, a metal shield having light-transmitting perforations formed therethrough positioned around an inside surface of said candle cover member and a candle positioned within the candle cover member wherein the metal shield is positioned between the candle and the candle cover member.

2. The fixture of claim 1 wherein the locking means comprises lug means carried at the top of one of the frame halves for lockable engagement with slot means formed in the other frame half and further comprises overlapping, apertured tongue means formed on the bases of each of the frame halves and fastener means for detachably joining the tongue means together.

3. The fixture of claim 1 wherein the base of each frame half includes a pedestal portion carrying locking lugs thereon adapted to lockably engage a slotted locking rim when in use.

4. The fixture of claim 1 wherein the mating frame halves are bronze castings.

5. The fixture of claim 1 wherein the frame halves are substantially symmetrical about a vertical parting plane and wherein the tops and bases of the respective frame halves are joined together by at least a pair of vertical ribs, extending along the parting plane.

6. A memorial candle fixture comprising:

frame means including two mating frame halves, each of said frame halves having a top and a base joined by rib means and defining an open region therebetween;

the top of each frame half having an upwardly extending, central protrusion, one of said protrusions having a slot formed therein and the other of said protrusions having an offset lug outwardly extending therefrom for detachable locking engagement with said slot when the frame halves are in a mated state;

candle means for placement into the open region of the frame means when the frame halves are in an unmated state;

apertured tongue means formed in the base of each of the frame halves for overlapping alignment when the frame halves are in a mated state; and fastener means for insertion into the apertured tongue means for locking the frame halves together when in the mated state, whereby the candle means is confined within the open region of the frame means.

7. The fixture of claim 6 wherein the frame halves are substantially symmetrical about a vertical parting plane and wherein the apertures of the tongue means have respective axes which are coextensive with said parting plane.

8. The fixture of claim 6 wherein the candle means includes a candle, a perforated metal shield positioned around the candle and a candle cover of an opaque plastic material positioned around the metal shield

9. The fixture of claim 8 wherein the frame means is a bronze casting and wherein the perforated metal shield of the candle means has an upper edge which is spaced above an upper edge of said plastic candle cover and wherein the upper edge of said metal shield contacts the top of the bronze casting to maintain a gap between the plastic candle cover and the bronze casting.

10. The fixture of claim 8 wherein the candle cover includes decorative indicia on a surface thereof.

11. The fixture of claim 6 wherein the base of each frame half includes a pedestal portion carrying locking lugs thereon, adapted in use to detachably engage a locking rim of an in-ground receptacle of a memorial plate.

12. The fixture of claim 11 including an anti-theft chain attached at one end to said pedestal and adapted to be attached to said in-ground receptacle at the other end.

13. The fixture of claim 11 wherein the frame means is adapted to be inverted and stored within said in-ground receptacle.

* * * * *

UNITED STATES PATENT AND TRADEMARK OFFICE

CERTIFICATE OF CORRECTION

PATENT NO. : 5,055,035

DATED : October 8, 1991

INVENTOR(S) : Hancovsky

It is certified that error appears in the above-identified patent and that said Letters Patent is hereby corrected as shown below:

Title page, under References Cited U.S. PATENT DOCUMENTS, insert
--2,685,023 7/1954 Valle 240/13
3,501,256 3/1970 Milliken 431/291
3,558,871 1/1971 Rogers 240/13--;
and
"4,260,365 4/1981 Kagne 362/161 X" should read
--4,260,365 4/1981 Kayne 362/161 X--.

Column 3, line 33 "lane" should read --plane--.
Column 3, line 35, "14, 14," should read --14, 14'--.
Column 4, line 4, "28, As" should read --28'. As--.
Column 4, line 5, "28 and 28," should read 28 and 28'--.
Column 5, line 44, "38," should read --38'--.
Claim 1, lines 31-32, column 6, after "wherein" delete
--the candle means is confined within the open region and
wherein--.
Claim 8, line 23, column 7, after "shield" insert -- . --.

Signed and Sealed this

Fourth Day of May, 1993

*Attest:*

*Attesting Officer*

Michael K. Kirk

MICHAEL K. KIRK

*Acting Commissioner of Patents and Trademarks*